US005897967A

United States Patent [19]

Hori et al.

[11] Patent Number: 5,897,967

[45] Date of Patent: Apr. 27, 1999

[54] GALVANNEALED STEEL SHEET AND MANUFACTURING METHOD THEREOF

[75] Inventors: Masahiko Hori, Nishinomiya; Toshio Nakamori, Ashiya; Yoshiaki Nakazawa, Kashima; Yasuyuki Tanno, Honjo, all of Japan

[73] Assignee: Sumitomo Metal Industries, Ltd., Osaka, Japan

[21] Appl. No.: 08/895,479

[22] Filed: Jul. 16, 1997

[30] Foreign Application Priority Data

Aug. 1, 1996 [JP] Japan ..... 8-203354

[51] Int. Cl.[6] ..... B32B 15/00

[52] U.S. Cl. ..... 428/659; 148/320; 148/533; 427/433; 420/126; 420/127

[58] Field of Search ..... 428/659; 148/320, 148/533; 420/126, 127; 427/433

[56] References Cited

U.S. PATENT DOCUMENTS

| | | | |
|---|---|---|---|
| 5,356,493 | 10/1994 | Tsuyama et al. | 148/320 |
| 5,690,755 | 11/1997 | Yoshinaga et al. | 428/659 |

FOREIGN PATENT DOCUMENTS

| | | |
|---|---|---|
| 59-31827 | 2/1984 | Japan . |
| 59-74232 | 4/1984 | Japan . |
| 62-023975 | 1/1987 | Japan . |
| 62-130268 | 6/1987 | Japan . |
| 62-133059 | 6/1987 | Japan . |
| 2-97653 | 4/1990 | Japan . |
| 3-191047 | 8/1991 | Japan . |
| 3-232927 | 10/1991 | Japan . |
| 3-294463 | 12/1991 | Japan . |
| 4-80349 | 3/1992 | Japan . |
| 4-154937 | 5/1992 | Japan . |
| 5-001353 | 1/1993 | Japan . |
| 5-059516 | 3/1993 | Japan . |
| 5-195148 | 8/1993 | Japan . |
| 5-230542 | 9/1993 | Japan . |
| 5-247620 | 9/1993 | Japan . |
| 6-025755 | 2/1994 | Japan . |
| 6-081044 | 3/1994 | Japan . |
| 6-81099 | 3/1994 | Japan . |
| 6-136503 | 5/1994 | Japan . |
| 7-278745 | 10/1995 | Japan . |

OTHER PUBLICATIONS

Laboratory Investigations on the Morphology of the Coating and the Forming Behavior of Galvannealed Steel Sheet, by R. Brisberger et al., *Galvatech '95 Conference Proceedings*, Sep. 17–21, 1995, pp. 753–759.

"Coating Microstructure Assessment and Control For Advanced Product Properties of Galvannealed IF Steels," by W. van Koesveld, et al., *Galvatech '95 Conference Proceedings*, Sep. 17–21, 1995, pp. 343–355.

*Primary Examiner*—John Sheehan

*Attorney, Agent, or Firm*—Burns, Doane, Swecker & Mathis, LLP

[57] ABSTRACT

A galvannealed steel sheet suited for use in automobiles, and a manufacturing method thereof. The steel sheet has tensile strength of 340 MPa or higher and paint bake hardenability of 10 MPa or higher, and excellent resistance to powdering when press formed, and excellent resistance to chipping in cold regions. The base metal of the galvannealed steel sheet consists essentially of C: 0.004–0.008%, Si: 2.5×P (%)–0.20%, Mn: 0.10–0.40%, P: 0.017–0.045%, sol. Al: 0.003–0.08%, Ti: 0.002–0.015%, Nb: 0.010–0.030 %, wherein Ti (%)+Nb (%): 0.012–0.035%. A steel sheet of the chemical composition described above is hot-dip galvanized, heated up to a Fe—Zn alloying temperature at a heating velocity of 20° C./sec or higher, and upon completion of the Fe—Zn alloying process, cooled down from the Fe—Zn alloying temperature at a cooling velocity of 10° C./sec or higher.

8 Claims, 1 Drawing Sheet

GALVANNEALED STEEL SHEET AND MANUFACTURING METHOD THEREOF

BACKGROUND OF THE INVENTION 1. (Field of the Invention)

The present invention relates to a galvannealed steel sheet suitable for use in automobiles as high strength steel sheet, plated with a coating having excellent powdering resistance, low temperature chipping resistance, and paint bake hardenability,as well as to a manufacturing method thereof.

2. (Description of the Related Art)

The galvannealed steel sheet has been in extensive use in recent years as steel sheet suitable for manufacturing automobile bodies. The galvannealed steel sheet is manufactured by applying a Fe—Zn alloying process to a hot-dip galvanized steel sheet, wherein the hot-dip galvanized steel sheet is heated up to a temperatures in the range from 500 to 600° C. for a retention time of 3 to 60 minutes. By means of Fe—Zn alloying, a Zn layer is turned into a Fe—Zn alloy layer containing 8 to 15 wt. % of Fe normally. In the case of a plated coating being composed of the Fe—Zn alloy layer, coating adhesion between the plated coating and paint is superior to an ordinary hot-dip galvanized steel sheet. Spot weldability is also improved in addition to markedly enhanced corrosion resistance after painting. Powdering resistance is degraded if the amount of Zn coating on the galvannealed steel sheet is excessive. Accordingly, the amount of the Zn coating is normally 20 to 70 g/m$^2$ of the surface of the steel sheet on one side.

In application of the galvannealed steel sheet described above for manufacturing automobile bodies, the following properties are required of the steel sheet with respect to formability thereof and corrosion resistance of a galvannealed coating:

(a) exfoliation of the galvannealed coating does not occur during plastic working of the steel sheet (powdering resistance), (b) excellent adhesion property of the galvannealed coating is maintained even in low temperature environments (low temperature chipping resistance), (c) a base metal has sufficient strength to be able to cope with requirement for higher strength, maintaining good formability, and (d) the steel sheet has adequate paint bake hardenability.

Powdering is a phenomenon wherein the plated coating is broken into fine pieces and exfoliated in a region where the steel sheet is subjected to compressive deformation during press working, generating powdery broken pieces of the plated coating. Fe—Zn alloy, being harder than ordinary Zn metal, the galvannealed coating is susceptible to pulverization when subjected to compressive deformation. Not only corrosion resistance is degraded at sites where powdering occurs, but also powdery pieces of the exfoliated galvannealed coating, adhered to a press die, give rise to a cause for defects on the surface of a formed product.

Low temperature chipping is a phenomenon wherein the galvannealed coating exfoliates from the interface between a base metal and the coating when deformation due to impact is caused to occur to a painted galvannealed steel sheet in low temperature environments. The low temperature chipping some times occurs when gravel, and the like collides with the painted surface of the body of an automobile being driven in a cold region, and the like, and it is highly desired to overcome this problem.

Enhanced strength is called for in order to reduce the weight of an automobile body from the viewpoint of improving fuel efficiency, and also to enhance dent resistance of exterior components of an automobile, such as door, and the like. The steel sheet for use in automobile bodies, having excellent formability, normally calls for tensile strength on the order of 300 MPa. However, the steel sheet having tensile strength in the range of 340 to around 400 MPa is in great demand nowadays to lighten the weight of an automobile body.

Paint bake hardenability (hereinafter referred to simply as "BH property") is a property of a metal for age hardening in a range of temperatures for baking paint although unsusceptible to age hardening at room temperature (a steel sheet having BH property is referred to hereinafter simply as "BH type steel sheet"). When press forming is performed on a BH type steel sheet, it maintains a yield strength as low as that of a steel sheet at the time of production thereof Accordingly, accurate shapes of automobile components are obtainable by press forming of the BH type steel sheet. The yield strength of the BH steel sheet goes up due to the effect of age hardening by paint baking after press forming thereof, thus increasing strength of a product after painting.

In other words, by press working of the BH type steel sheet, accurate shapes of components are obtainable with ease, and after painting, high strength of components is obtained. These are highly necessary properties of steel sheets used for manufacturing exterior components of an automobile, requiring both accurate shapes and dent-defect-resistance property (hereinafter referred to as dent resistance).

It means that the galvannealed steel sheet used for an automobile body calls for not only press formability, high strength, and BH property but also excellent adhesion property of the galvannealed coating, that is, powdering resistance, and low temperature chipping resistance.

Various measures for improving powdering resistance are proposed including optimization of an amount of Zn coating, an amount of Al added to a plating bath, and Fe content of the galvannealed coating, and further, restriction on such amounts of alloying elements added to the base metal as may adversely affect the adhesive property of the plated coating.

Both powdering and chipping are phenomena wherein the plated coating exfoliates. Therefore, it was believed in the past that improvement in powdering resistance would be accompanied by improvement in low temperature chipping resistance. In fact, however, improved powdering resistance does not necessarily result in improvement in low temperature chipping resistance. It has since been found that low temperature chipping resistance is primarily dependent on adhesion property at the interface between the plated coating and the surface of the base metal. Accordingly, a method is proposed whereby adhesion property of the plated coating on the surface of the base metal is enhanced.

A galvannealed steel sheet having excellent formability and a manufacturing method thereof are disclosed in Japanese Patent Laid-open (Kokai) No. 2-97653 (1990). The steel sheet described above is characterized in that when same is cut after painted, a plated coating is not susceptible to exfoliation readily from the surface of a cut end thereof. It is said that the steel sheet has a structure formed by intrusion and diffusion of Zn into grain boundaries of the surface of a base metal thereof with Zn each substantially in the shape of a wedge residing on the grain boundaries, preventing the plated coating from exfoliating from the surface of the base metal easily.

The steel sheet as described above can be manufactured by plating the base metal in a plating bath containing Al in a concentration higher than that for normal cases, and by applying the Fe—Zn alloying process thereto at higher temperatures than in normal cases for an extended period of time. However, the Fe—Zn alloying process applied at high temperatures tends to impair powdering resistance, and a longer process time of the Fe—Zn alloying lowers productivity. Furthermore, such a method of processing as described above is regarded effective in prevention of exfoliation of the plated coating from the surface of the cut end of the steel sheet, however, its relationship with chemical composition of the base metal, and its effect on low-temperature chipping resistance are yet to be made clear.

Elements such as Si and P have an effect of increasing strength of the steel sheet without sacrificing much formability thereof, and besides, are inexpensive alloying elements. Therefore, Si and P are alloying elements suited for increasing the strength of the steel sheet. However, Si and P hinder amenability of the base metal to plating. It is known that addition of excessive Si to the base metal results in non-plating, and slowing-down of the alloying velocity. It is also known that P is an alloying element responsible for slowing down the alloying velocity. This is believed to be due to a tendency of P being segregated around the grain boundaries of the base metal, restraining reaction between the grain boundaries of the base metal containing P in high concentration and Zn. Accordingly, it is not easy to achieve both higher strength of the steel sheet and amenability thereof to plating by use of these elements.

A galvannealed steel sheet having excellent adhesion between a plated coating and a base metal, suitable for use as painted steel sheet for application to home appliances, and as steel sheet for automobiles, is disclosed in Japanese Patent Laid-open (Kokai) No. 6-81099 (1994). According to the aforesaid invention, an ultra-low carbon steel containing Si with decreased amount of P is used as the base metal for improving adhesion property thereof, and the surface of the steel, at the interface between the plated coating and the base metal after the Fe—Zn alloying process, is rendered rough with intense asperities so that coating adhesion is improved, enhancing chipping resistance after painting. P content in the base metal is controlled at a level as low as possible, and C content, regarded detrimental for improving coating adhesion, is also held at an ultra-low level, being kept stable with addition of Ti.

It is reported (by W. van. Koesveld et al: GALVATEC '95 Conference Proceedings, p. 343–353) that intrusion of Zn into the grain boundaries of a base metal is promoted by addition of Si to an ultra-low carbon steel with Ti added thereto, enhancing coating adhesion at the interface between a plated coating and said steel as the base metal. However, the technology disclosed in the above report is intended for application to IF steel of low strength, of which the base metal contains no solute C, and no mention is made to P-bearing steel of high strength.

A galvannealed steel sheet with BH property, having excellent powdering resistance, and a manufacturing method thereof are disclosed in Japanese Patent Laid-open (Kokai) No. 4-80349 (1992), for example. According to the aforesaid invention, P content of the steel sheet is controlled at 0.03 percent or lower for enhancing adhesion property of a plated coating while B is added for holding powdering in check. Further, the steel sheet contains Nb 2 to 7.5 times as much as C content therein for obtaining BH property. According to description of the invention, powdering resistance is improved, however, no mention is made of low temperature chipping resistance. In the case of the steel sheet, P content held down at a low level and there is also a risk of its formability being impaired with addition of B.

A cold rolled steel sheet and a hot-dipped galvanized steel sheet, having excellent BH property and secondary workability, and a manufacturing method thereof are disclosed in Japanese Patent Laid-open (Kokai) No. 5-195148 (1993). In the case of the steel sheets according to the invention, an ultra low carbon steel containing Si and P is used as the base metal. Its BH property and secondary workability are said to be obtained by keeping a ratio of Ti content to S content in an optimum range so that species of precipitates are controlled. However, neither Si nor P is added to the galvanized steel sheet described in an embodiment of the invention. Further, neither any evaluation is made on adhesion property of a plated coating nor any mention is made on low temperature chipping resistance.

Thus, a number of proposals have been made for various steel sheets excelling in respective properties, for example, a galvannealed steel sheet having BH property, same having excellent powdering resistance, or same having excellent low temperature chipping resistance, and the like. However, a steel sheet having all the properties including strength, BH property, powdering resistance, and low temperature chipping resistance, all of which are above predetermined levels, has not been developed as yet.

SUMMARY OF THE INVENTION

It is an object of the present invention to provide a galvannealed steel sheet with excellent powdering resistance, excellent chipping resistance in low temperature environments, having good press formability, as well as high tensile strength and adequate BH property, and a manufacturing method thereof.

A base metal of the galvannealed steel sheet according to the present invention consists essentially, on the basis of percent by weight, of:

C: 0.004–0.008%; Si: 2.5×P(%)–0.20%;

Mn: 0.10–0.40%; P: 0.017–0.045%;

sol. Al: 0.003–0.08%; S: 0.015% or less;

Ti: 0.002–0.015%; Nb: 0.010–0.030;

Ti (%)+Nb(%): 0.012–0.035%; N: 0.004% or less;

balance: Fe and inevitable impurities.

A galvannealed steel sheet according to the present invention is manufactured by a process which comprises the steps of hot rolling a steel slab having a chemical composition as described above, subjecting the hot rolled steel sheet, after descaling, to cold rolling, annealing the cold rolled steel sheet, plating the steel sheet with zinc in the hot-dip galvanizing line, and then heating up same to the Fe—Zn alloying temperature for Fe—Zn alloying. In the course of the Fe—Zn alloying process, it is preferable to heat the steel sheet up to the Fe—Zn alloying temperature at a heating velocity of 20° C./sec or higher, and to cool it down rapidly from the Fe—Zn alloying temperature at a cooling velocity of 10° C./sec or higher. After the Fe—Zn alloying process, skin pass rolling and the like are applied to finish manufacturing the product.

Tensile strength of the galvannealed steel sheet is 340 MPa or higher, and the magnitude of bake hardenability thereof is 10 MPa or higher.

DETAILED DESCRIPTION OF THE INVENTION

Figure 1:
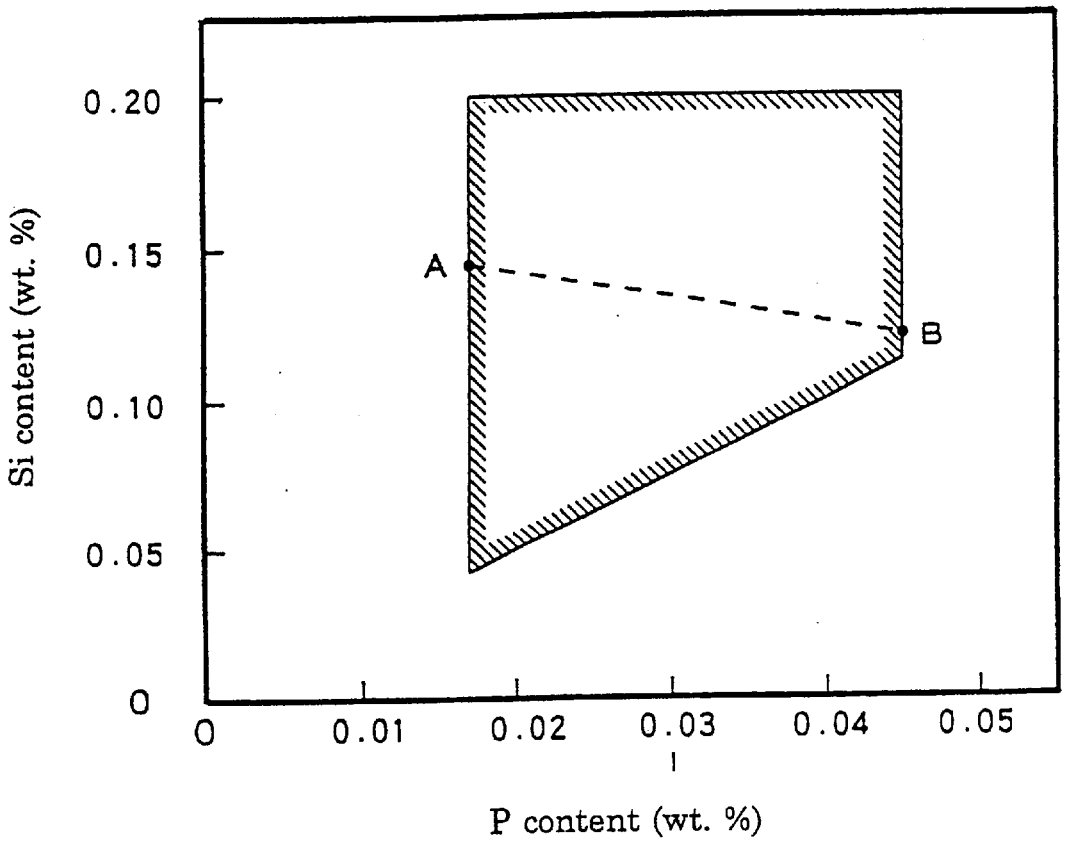
FIG. 1 shows the ranges of a Si content and a P content in the base metal of the galvannealed steel sheet according to the invention.

The means for solving the problems according to the invention is based on the following concepts:

(a) An ultra-low carbon steel is used as a base metal for producing a steel sheet having excellent formability and suitable for use in automobile bodies. Alloying elements such as Si, P, and the like, effective for solid solution hardening, are added to the aforesaid steel so as to enhance tensile strength thereof at a low cost without impairing formability. Although low temperature chipping resistance of a plated coating is normally degraded by addition of P to the base metal of the galvannealed steel sheet, same can be not only maintained but also enhanced by raising a Si content corresponding to an increase in a P content. In particular, when the Si content is increased to 2.5 times or more as much as the P content, a pronounced effect of improvement in the low temperature chipping resistance is observed.

An increase in the P content results in an increase in an amount of P segregated on grain boundaries of the surface of the base metal. As a result, diffusion of Zn into the grain boundaries is restricted, a wedge-like effect of Zn near the grain boundaries being deprived. However, localized intrusion of Zn into the grain boundaries and the like is promoted by addition of a suitable amount of Si, resulting in an enhanced anchoring effect of the plated coating, and leading to an improvement in the low temperature chipping resistance.

(b) In an embodiment of the present invention, a trace amount of Nb is added to the base metal in addition to P and Si already added thereto to ensure high strength of the steel sheet. This is necessary because addition of P and Si only is insufficient to provide the steel sheet with adequate strength since both the P content and the Si content need to be restricted to ensure amenability of the steel sheet to plating. In the case of the ultra-low carbon steel, it was thought in the past that the effect of addition of Nb on an increase in the strength of the steel was small. However, the strength of the steel can be increased by adding trace amounts of C and Nb to the base metal in addition to a small amount of solute carbon required for achieving BH property. Presumably, this is due to the effects of finer grain structure and precipitation of fine Nb-carbide. Addition of a trace amount of Nb has no adverse effect on the performance of the plated coating.

(c) Low temperature chipping resistance is enhanced by increasing a heating velocity during the Fe—Zn alloying process. This is thought to be due to an increase in the anchoring effect of the plated coating as a result of rapid heating of the steel sheet, facilitating diffusion and intrusion of Zn into the grain boundaries of the base metal. Diffusion of Zn into the grain boundaries is promoted when molten Zn is in contact with the surface of the base metal heated up to the Fe—Zn alloying temperature rather than when Fe—Zn alloy in solid phase is in contact therewith. A melting point of Fe—Zn alloy rises corresponding to an increase in a Fe content of the alloy. Accordingly, rapid heating is necessitated to cause Zn (η phase) having a low melting point to remain when heated up to the Fe—Zn alloying temperature.

Further, the powdering resistance is improved by increasing a cooling velocity after Fe—Zn alloying process, and at the same time, BH property is obtained with greater ease. The powdering resistance is degraded when Fe—Zn alloying reaction proceeds too excessively. Rapid cooling after the Fe—Zn alloying process can prevent excessive alloying reaction from occurring at the time of cooling.

Bake hardenability of the steel sheet is greatly influenced by an amount of solute C contained in the steel sheet. When a velocity of cooling from the Fe—Zn alloying temperature slows down, the solute C is precipitated in the cooling process, decreasing the bake hardenability of the steel sheet. Therefore, the velocity of cooling from the Fe—Zn alloying temperature needs to be increased to ensure adequate bake hardenability of the galvannealed steel sheet.

The chemical composition, on the basis of percent by weight, of the base metal of the steel sheet according to the invention, and reasons for specifying preferred manufacturing conditions and the like of the steel sheet according to the invention are described hereafter.

C: Carbon in an amount of 0.004% or higher is to be contained to ensure the bake hardenability and the tensile strength. In case of a C content being less than 0.004%, the bake hardenability becomes insufficient, and at the same time, an effect of enhancing tensile strength resulting from C contained in the base metal in combination with Nb as described hereafter is not achieved. In case of the C content exceeding 0.008%, drawing property of a cold rolled base metal, after annealing, deteriorates. In addition, as strain aging progresses, and formability of the steel sheet deteriorates, the steel sheet becomes susceptible to stretcher strain and unsuitable for use in exterior components of automobiles. Accordingly, the upper limit of the C content is set at 0.008%. The C content in the range from 0.005 to 0.007% is preferable from the viewpoint of ensuring the strength, the bake hardenability and the formability of the steel sheet.

Si: Objects of adding silicon is to improve the low temperature chipping property tending to be degraded corresponding to an increase in the P content, and also to enhance tensile strength of a steel sheet as the base metal. The Si content needs to be increased corresponding to an increase in the P content to maintain the low temperature chipping resistance in an adequate range.

Accordingly, a lower limit of the Si content needs to be controlled in association with the P content. In case of the Si content being less than 2.5×P(%), the low temperature chipping resistance is not sufficiently improved. On the other hand, in case of the Si content exceeding 0.20%, a tenacious oxidized film is formed on the surface of the steel sheet at the time of annealing and the like prior to hot-dip galvanizing, involving a risk of non-plating occurring during the hot-dip galvanizing process due to resultant poor wettability of the steel sheet with Zn. Accordingly, the Si content is set to be in the range from 2.5×P(%) to 0.2%.

As the Si content of the base metal increases, an alloying velocity of the plated coating slows down. Presumably, this is due to formation of a Si oxide film on the surface of the base metal, hindering diffusion of Fe atoms into the plating coating. Excessively slow alloying velocity lowers productivity, and is naturally undesirable.

The alloying velocity can be increased by, for example, reducing an Al content of a plating bath or accelerating a velocity of heating the steel sheet up to the Fe—Zn alloying temperature. Without resorting to such measures as above, however, slowing-down of the alloying velocity can be prevented by controlling the Si content at (−6/7)×P(%)+0.16 or less. Accordingly, the Si content may preferably be kept at (−6/7)×P(%)+0.16 or less.

FIG. 1 is a graph showing ranges of the Si content and the P content of the base metal of the galvannealed steel sheet according to the invention, and a low Si region below the line A–B in the figure indicates the preferable ranges described above.

Mn: Mn needs to be contained in an amount of at least 0.1% to prevent hot shortness due to the effect of S. Mn is added whenever necessary because of its ability for enhancing the strength of steel, however, its effect on enhancement of the strength is less than that of Si in the same amount. Moreover, Mn is more expensive, and an excessive content thereof lowers bake hardenability, hindering improvement in the low temperature chipping resistance, due to addition of Si. Therefore, the upper limit of a Mn content is set at 0.40%.

P: P is effective in enhancing the strength of steel, and a degree to which formability of a steel sheet is impaired thereby is less than other elements added for enhancing the strength. Moreover, P is less expensive. In embodiments of the present invention, the steel sheet contains P in an amount of 0.017% or more to maximize its effect of enhancing the strength. However, as the P content increases, the low temperature chipping resistance is degraded considerably. Excessive P content renders improvement of the low temperature chipping resistance unattainable even if the Si content is increased. There is set a upper limit of the P content is set at 0.04%. For further improvement of the low temperature chipping resistance, the P content may preferably be controlled at 0.035% or less.

Al: Al acts as deoxidizer in a stage of refining steel. In case of a Al content being less than 0.003%, deoxidizing effect thereof is insufficient. In case of the Al content being excessive, not only the deoxidizing effect reaches a saturation point but also coating adhesion is degraded. Therefore, the upper limit thereof is set at 0.08%. For further improvement of the coating adhesion, the Al content may preferably be set at 0.04% or less.

Ti: Ti has an ability to combine with N, S, and a portion of C, forming precipitates, and to improve deep drawing property of the steel. In case of a Ti content being less than 0.002%, such ability becomes insufficient, and in case of the Ti content exceeding 0.015%, a risk of the bake hardenability being degraded arises. Accordingly, the Ti content is set to fall in the range from 0.002 to 0.015%.

Nb: Nb has an ability to form NbC in the presence of a small amount of C, enhancing the strength of steel. In case of a Nb content being less than 0.010%, the effect of such ability is insufficient, and in case of the Nb content exceeding 0.030%, formability of the steel is degraded. Therefore, the Nb content is set to fall in the range from 0.010 to 0.030%.

Presence of Nb concomitant with Ti in a steel sheet results in further improvement of press formability of the steel sheet as base metal. However, since both Ti and Nb combine with carbon, reducing solute carbon, a total content of (Ti+Nb) is set to fall in the range from 0.012 to 0.035%. In case of the content of (Ti+Nb) being less than 0.012%, an amount of solute carbon becomes excessive, increasing strain aging at room temperature and degrading press formability, both of which are undesirable. In case of the content of (Ti+Nb) exceeding 0.035%, the amount of the solute carbon becomes insufficient, resulting in poor bake hardenability.

Elements other than the elements described above are Fe and incidental impurities. The less in amounts the incidental impurities are, the better. In particular, since S and N combine with Ti, forming precipitates and nonmetallic inclusions, an increase in a S content or a N content results in poor formability. Therefore, the incidental impurities are restricted to 0.015% or less of S and 0.004% or less of N.

The galvannealed steel sheet according to the present invention is preferably manufactured by the following method. Molten steel of the chemical composition described in the foregoing is produced in the conventional converter or electric furnace, refined by the vacuum treatment and the like, cast into a slab by the continuous casting method or rolled to a slab by blooming an ingot, hot rolled into a hot rolled steel strip. The slab may be directly hot rolled or rolled after being fed into a reheating furnace for reheating. The finishing temperature in the hot rolling process is preferably in the range from 880 to 980° C. The upper limit of the temperature is determined from consideration of defects formed on the surface of a steel strip, and the lower limit from the transformation point Ar3. The coiling temperature is preferably in the range from 450 to 750° C. In case of importance being attached to formability in drawing, the steel strip may be taken out at high temperatures although surface defects such as scale defect occur at a temperature exceeding 750° C.

The hot rolled steel strip is cold rolled after an oxide film formed on the surface thereof is removed by a suitable means such as cleaning in an acid bath, and the like. Cold rolling may preferably be performed at a reduction in the range of 60 to 90%. When the reduction is too low, deep drawing property is impaired, and when it is too high, not only deep drawing property is impaired but also a rolled product is more susceptible to occurrence of the surface defects due to excessive rolling loads. Accordingly, cold rolling may more preferably be performed at a reduction in the range of 75 to 85%. After the cold rolling, the steel strip is hot-dip galvanized in the continuous hot-dip galvanizing system, and subsequently, the Fe—Zn alloying process is applied thereto.

In hot-dip galvanizing, the steel strip is reheated in the continuous reheating furnace by the conventional method for reduction of the surface thereof and recrystallization annealing. The annealing temperature of the base metal may preferably be in the range from 700° C. to lower than Ac3. The higher the annealing temperature, the more the deep drawing property is enhanced. On the other hand, the higher annealing temperature promotes excessive grain growth, decreasing the strength of the steel sheet, and increasing a risk of a surface defect such as orange peel appearing on the surface of the press formed steel sheet. When the annealing temperature is too low, the deep drawing property becomes poor. Accordingly, the range of the annealing temperatures is preferably from 750 to 850° C.

The annealed steel sheet is then cooled down to a temperature of a galvanizing bath, and hot-dip galvanized. When the temperature of the galvanizing bath is too high, excessive evaporation of Zn occurs, creating operational problems. On the other hand, when same is too low, solidification of Zn proceeds with ease, making it difficult to control an amount of Zn coating. Consequently, the temperature of the galvanizing bath may preferably be controlled to remain in the range from 450 to 490° C. Further, the galvanizing bath may preferably contain Al in amounts of 0.08 to 0.15% by weight to make it easier to control the amount of Zn coating. When the amount of Zn coating is excessive, a risk of powdering increases. Therefore, the amount of Zn coating may preferably be controlled to be in the order of 20 to 70 g/m$^2$ of the surface on one side. Herein, the amount of Zn coating represents that of Fe—Zn alloy.

The galvanized steel sheet is then heated up to the Fe—Zn alloying temperature, and the Fe—Zn alloying process is applied thereto. The Fe—Zn alloying temperature may preferably be set in the range from 480 to 600° C. In case of the Fe—Zn alloying temperature being lower than 480° C., the process time is lengthened due to slowing-down of the alloying reaction speed, and in case of same exceeding 600° C., the alloying process proceeds too fast. Accordingly, the more preferable range of the Fe—Zn alloying temperature is from 500 to 540° C. The Fe—Zn alloying temperature and a retention time at the temperature may preferably be controlled such that a Fe content of the galvannealed coating falls within the range from 8 to 15 wt. %. In case of the Fe content of the galvannealed coating being less than 8 wt. %, coating adhesion of paint and corrosion resistance after painting are insufficient. The higher Fe content is desirable from the viewpoint of enhancing the low temperature chipping resistance, however, the powdering resistance is improved when the Fe content is lower. A steel sheet excelling in both properties may preferably be produced by controlling the Fe content at 15 wt. % or less.

Further, the low temperature chipping resistance may preferably be improved by heating up the steel sheet at a heating velocity of 20° C./sec or higher in a temperature range at 480° C. or lower during the Fe—Zn alloying process, and by cooling down same at a cooling velocity of 10° C./sec or higher from the Fe—Zn alloying temperature.

When the heating velocity is 20° C./sec or higher, the low temperature chipping resistance can be improved, and the higher the heating velocity is, the better in this connection. However, as excessively rapid heating results in instability of a final temperature reached or requires excessively large facilities, the upper limit may preferably be set at 50° C./sec. The heating velocity may more preferably be set to fall in the range from 20 to 40° C./sec.

When the cooling velocity is increased, excessive reaction of the Fe—Zn alloying is restricted, improving the powdering resistance, and solute carbon is allowed to remain with greater ease, providing sufficient bake hardenability. Accordingly, the cooling velocity when cooling from the Fe—Zn alloying temperature may preferably be set at 10° C./sec or higher. Although the cooling velocity has no upper limit, an excessively high cooling velocity may cause deformation of the steel sheet. Accordingly, the cooling velocity at 50° C./sec or lower is preferable.

The steel sheet is cooled after completion of the Fe—Zn alloying process, and further treatments such as skin pass rolling, roller leveling, and the like may be applied thereto by conventional methods. Further, post-treatments such as chromate treatment, and the like may be applied whenever necessary.

The galvannealed steel sheet is required to have tensile strength of 340 MPa or higher to demonstrate its beneficial effect of light-weight on application to automobiles. The upper limit of the tensile strength required is not specified, but effectively, around 400 MPa to ensure good formability and provide that amounts of the alloying elements added are within same specified in the invention.

Bake hardenability of 10 MPa or higher is required to ensure satisfactory dent resistance. The bake hardenability of 20 MPa or higher is preferable to obtain still higher dent resistance. The higher the bake hardenability, the better in this connection. However, excessively high bake hardenability promotes aging at room temperature, rendering the steel sheet susceptible to defects such as degradation in formability, stretcher strain during the forming process, and the like. Accordingly, the upper limit of the bake hardenability may preferably set at 70 MPa. The more preferable range of the bake hardenability is from 30 to 60 MPa.

The bake hardenability is measured according to the method described in the procedure for paint bake hardenability test as specified in the appendix to JIS-G-3135. The method is summarized hereafter.

A load ($F_{WH}$) when 2% of elongation strain is applied to a testpiece for tensile test is recorded, and the load is removed. Then, heat treatment at 170° C. is applied to the testpiece for 20 minutes, and the testpiece is cooled down to room temperature. Subsequently, the testpiece is subjected to a tensile test to find a yield load ($F_{SA}$). The bake hardenability is a value obtained by dividing a difference between the respective loads by the initial cross-sectional area of the testpiece ($A_O$) as follows:

$$BH=(F_{SA}-F_{WH})/A_O$$

(EMBODIMENTS)

Example 1

Slabs of various chemical compositions were manufactured by applying the vacuum degassing treatment and the continuous casting method to molten steel refined in a converter. The results of analyses of these steels in the ladle are shown in Table 1. The slabs were then fed into a reheating furnace, heated to 1200° C., and hot rolled into coiled steel strips, 3.6 mm in thickness and 1250 mm in width. The finishing temperatures during hot rolling process for these coils ranged from 910 to 930° C., and the coiling temperatures from 640 to 670° C. The hot rolled coils are then descaled in an acid bath and cold rolled into steel sheets, 0.70 mm in thickness. The reduction of the cold rolling process was 81%.

Specimens, each 200 mm long and 80 mm wide, were cut out from respective steel sheets as described above. The hot-dip galvanizing process was applied to the specimens under the conditions described hereafter using a simulator for hot-dip galvanizing.

TABLE 1

| Specimen | Chemical Composition Balance; Fe and Incidental Impurities (wt %) | | | | | | | | | | | |
|---|---|---|---|---|---|---|---|---|---|---|---|---|
| Steel Mark | C | Si | Mn | P | S | sol.Al | N | Ti | Nb | 2.5P | Ti + Nb | Remark |
| A | 0.0041 | 0.10 | 0.18 | 0.019 | 0.007 | 0.040 | 0.0024 | 0.007 | 0.025 | 0.048 | 0.032 | Examples of the Invention |
| B | 0.0061 | 0.08 | 0.16 | 0.022 | 0.006 | 0.028 | 0.0037 | 0.006 | 0.022 | 0.055 | 0.028 | |
| C | 0.0080 | 0.07 | 0.20 | 0.017 | 0.005 | 0.020 | 0.0021 | 0.002 | 0.028 | 0.043 | 0.030 | |
| D | 0.0042 | 0.07 | 0.16 | 0.023 | 0.008 | 0.030 | 0.0022 | 0.007 | 0.025 | 0.058 | 0.032 | |
| E | 0.0043 | 0.09 | 0.18 | 0.019 | 0.006 | 0.030 | 0.0024 | 0.007 | 0.020 | 0.048 | 0.027 | |
| F | 0.0045 | 0.13 | 0.20 | 0.020 | 0.006 | 0.012 | 0.0027 | 0.009 | 0.025 | 0.050 | 0.034 | |
| G | 0.0055 | 0.15 | 0.35 | 0.017 | 0.010 | 0.033 | 0.0034 | 0.007 | 0.024 | 0.043 | 0.031 | |
| H | 0.0042 | 0.10 | 0.22 | 0.026 | 0.006 | 0.032 | 0.0023 | 0.004 | 0.019 | 0.065 | 0.023 | |
| I | 0.0052 | 0.15 | 0.28 | 0.028 | 0.003 | 0.021 | 0.0027 | 0.015 | 0.015 | 0.070 | 0.030 | |
| J | 0.0041 | 0.17 | 0.18 | 0.031 | 0.005 | 0.035 | 0.0025 | 0.007 | 0.018 | 0.078 | 0.025 | |
| K | 0.0045 | 0.11 | 0.15 | 0.035 | 0.006 | 0.038 | 0.0022 | 0.007 | 0.019 | 0.088 | 0.026 | |

TABLE 1-continued

| Specimen | Chemical Composition Balance; Fe and Incidental Impurities (wt %) | | | | | | | | | | | |
|---|---|---|---|---|---|---|---|---|---|---|---|---|
| Steel Mark | C | Si | Mn | P | S | sol.Al | N | Ti | Nb | 2.5P | Ti + Nb | Remark |
| L | *0.0023 | *0.02 | 0.15 | *0.010 | 0.005 | 0.035 | 0.0028 | 0.007 | *0.006 | 0.025 | 0.013 | Examples |
| M | *0.0033 | 0.20 | 0.15 | *0.013 | 0.005 | 0.030 | 0.0031 | 0.009 | *0.008 | 0.033 | 0.017 | of the |
| N | *0.0031 | 0.16 | 0.20 | *0.055 | 0.005 | 0.032 | 0.0039 | 0.009 | *0.008 | 0.138 | 0.017 | Comparison |
| O | *0.0023 | *0.02 | *1.20 | 0.035 | 0.005 | 0.030 | 0.0031 | 0.009 | *0.005 | 0.088 | 0.014 | |
| P | 0.0041 | *0.01 | 0.30 | 0.019 | 0.007 | 0.040 | 0.0021 | 0.007 | 0.025 | 0.048 | 0.032 | |
| Q | 0.0045 | *<0.01 | 0.30 | 0.020 | 0.007 | 0.040 | 0.0026 | 0.007 | 0.025 | 0.050 | 0.032 | |
| R | 0.0055 | *0.02 | 0.20 | 0.021 | 0.005 | 0.055 | 0.0029 | 0.007 | 0.020 | 0.053 | 0.027 | |
| S | 0.0050 | *0.02 | 0.15 | 0.025 | 0.005 | 0.038 | 0.0025 | 0.009 | 0.028 | 0.063 | *0.037 | |
| T | 0.0050 | 0.12 | 0.15 | *0.015 | 0.005 | 0.038 | 0.0026 | 0.009 | 0.028 | 0.038 | *0.037 | |
| U | 0.0050 | *0.03 | 0.18 | 0.019 | 0.009 | 0.039 | 0.0030 | 0.013 | 0.030 | 0.048 | *0.043 | |
| V | 0.0045 | *0.03 | 0.13 | 0.023 | 0.005 | 0.022 | 0.0033 | 0.007 | 0.022 | 0.058 | 0.029 | |

*Denotes outside the range specified by the invention.

Firstly, preheating was applied to the specimens wherein the specimens were heated up to 550° C. at a heating velocity of 15° C./sec in a nitrogen atmosphere containing oxygen in concentration of 500 ppm or less, and retained for 3 sec. Thereafter, annealing was applied to the specimens wherein the specimens were heated up to 800° C. at a heating velocity of 15° C./sec in an atmosphere consisting of 10% by volume of hydrogen having the dew point at −30° C. and balance of nitrogen, and retained for 60 sec.

Then the specimens were air cooled to 460° C., immersed in a plating bath, and hot-dip galvanized. The hot-dip galvanizing process was applied under conditions that concentration of Al in the plating bath was 0.12%, the temperature of the plating bath at 460° C., and retention time after immersion was 3 sec. An amount of zinc coating was adjusted to be 30 to 60/m$^2$ on one side of the respective specimens by varying amounts of high pressure air blasted on the coated surface.

Galvanized specimens were cooled to the room temperature, and heated up to 480° C. to 580° C. at a heating velocity of 25° C. using an induction heating apparatus. Retention time at the Fe—Zn alloying temperature was varied such that a Fe content of galvannealed coating falls within a predetermined range. Thereafter, the specimens were cooled down to room temperature at a cooling velocity of 10° C./sec by spraying mist consisting of water and nitrogen gas.

No. 5 type testpieces in accordance with JIS-Z-2201 were cut out from the specimens prepared by the Fe—Zn alloying process, and subjected to the tensile strength test. Bake hardenability is also measured in accordance with the procedure described in the appendix to JIS-G-3135. Further, a galvannealed coating of respective testpieces was dissolved in a solution of 6% hydrochloric acid with addition of inhibitor to measure an amount of the galvannealed coating, and to analyze a Fe content of the galvannealed coating.

Powdering resistance was evaluated by the following method. A blank 60 mm in diameter was punched out from each of the specimens after galvannealed, and press formed into a cylindrical cup by use of a die, provided with a punch 30 mm in diameter. Measurement was taken of a total weight of the galvannealed coating exfoliated from the external surface of the side wall of the respective cylindrical cups by use of an adhesive tape. In case of the weight of an exfoliated coating being less than 25 mg, the powdering resistance of a specimen is regarded up to the standard.

Low temperature chipping resistance was evaluated by the following method. A testpiece 150 mm long and 70 mm wide was cut out from each of the galvannealed specimens, and cleaned in an acid bath for removal of grease, and an immersion type phosphating treatment of the base metal was applied ( an amount of coating: 3–7 g/m$^2$) to the testpiece. Thereafter, three-coat painting (aggregate thickness of coatings : about 100 $\mu$m) by use of cation type electrophoretic paint, consisting of an undercoat (thickness: 20 $\mu$m), an intermediate coat (thickness: 35–40 $\mu$m), and a top coat (thickness: 35–40 $\mu$m), was applied thereto, thus preparing a painted steel sheet testpiece.

Each of the painted steel sheet testpieces was cooled down to −20° C., and caused to collide with 10 pebbles, each 4 to 5 mm in diameter, at a velocity ranging from 100 to 150 km/ h, against the surface of the painted steel sheet testpiece. Then, the maximum sizes of respective exfoliated 10 pieces of the galvannealed coating was measured and the mean value thereof was calculated. In case of the mean value being less than 3.5 mm, the low temperature chipping resistance was classified as up to the standard.

The results of the tests described above are shown in Table 2.

TABLE 2

| | | Fe—Zn | | | Mechanical Properties | | | | |
|---|---|---|---|---|---|---|---|---|---|
| Test Piece | Specimen Steel | Amount of Coating (g/m2) | Alloying Temperature (° C.) | Fe Content of Coating (%) | Tensile Strength (MPa) | Bake Hardenability (MPa) | Powdering Resistance *1 | Low Temperature Chipping Resistance *2 | Resistance Remark |
| 1 | A | 55 | 530 | 11 | 358 | 18 | ⊛ | ⊛ | Examples |
| 2 | B | 55 | 520 | 12 | 355 | 40 | ⊛ | ⊛ | of the |
| 3 | C | 45 | 560 | 12 | 360 | 40 | ⊛ | ○ | Invention |
| 4 | D | 30 | 530 | 12 | 355 | 18 | ⊛ | ⊛ | |
| 5 | D | 55 | 530 | 10 | 355 | 18 | ⊛ | ⊛ | |
| 6 | E | 45 | 550 | 10 | 350 | 25 | ⊛ | ⊛ | |

TABLE 2-continued

| Test Piece | Specimen Steel | Amount of Coating (g/m2) | Fe—Zn Alloying Temperature (° C.) | Fe Content of Coating (%) | Mechanical Properties Tensile Strength (MPa) | Bake Hardenability (MPa) | Powdering Resistance *1 | Low Temperature Chipping Resistance *2 | Resistance Remark |
|---|---|---|---|---|---|---|---|---|---|
| 7 | F | 55 | 570 | 13 | 355 | 20 | ⊛ | ⊛ | |
| 8 | G | 40 | 520 | 8 | 360 | 35 | ⊛ | ⊛ | |
| 9 | H | 30 | 550 | 12 | 355 | 25 | ⊛ | ⊛ | |
| 10 | I | 45 | 580 | 12 | 360 | 40 | ⊛ | ⊛ | |
| 11 | J | 60 | 560 | 11 | 360 | 25 | ⊛ | ⊛ | |
| 12 | K | 55 | 560 | 10 | 360 | 30 | ⊛ | ⊛ | |
| 15 | L | 60 | 520 | 11 | 315 | 5 | ○ | Δ | Examples |
| 16 | M | 45 | 480 | 10 | 330 | 15 | ⊛ | ⊛ | of the |
| 17 | N | 45 | 500 | 12 | 375 | 35 | Δ | Δ | Comparison |
| 18 | O | 35 | 530 | 12 | 365 | 10 | Δ | x | |
| 19 | P | 45 | 520 | 11 | 375 | 10 | ○ | x | |
| 20 | Q | 55 | 530 | 10 | 355 | 15 | ⊛ | x | |
| 21 | R | 35 | 510 | 9 | 356 | 40 | ○ | x | |
| 22 | S | 45 | 550 | 12 | 348 | 7 | Δ | x | |
| 23 | T | 30 | 520 | 12 | 360 | 8 | ⊛ | ⊛ | |
| 24 | U | 55 | 550 | 13 | 360 | 7 | ○ | Δ | |
| 25 | V | 60 | 540 | 12 | 358 | 20 | ○ | Δ | |

note)
*1 Powdering Resistance
⊛ : less than 15 mg,
○: 15 mg or above but less than 25 mg,
Δ: 25 mg or above but less than 35 mg,
x: 35 mg or above.
*2 Low Temperature Chipping Resistance
⊛ : less than 2.5 mm,
○: 2.5 mm or above but less than 3.5 mm,
Δ: 3.5 mm or above but less than 4.5 mm,
x: 4.5 mm or above.

As is evident from the test results of the testpieces denoted by reference numbers 1 to 12 shown in Table 2, the galvannealed steel sheets meeting the conditions specified by the present invention have a high strength on the order of at least 340 MPa for tensile strength, an adequate bake hardenability on the order of at least 10 MPa, excellent powdering resistance and excellent low temperature chipping resistance.

On the other hand, in the case of specimen steel denoted by L and M, having low contents of C, P and Nb, adhesion of the galvannealed coating is excellent, but tensile strength is too low. Also, bake hardenability of specimen steel L is low. Specimen steel N, having a P content in excess of the range specified by the present invention, has poor low temperature chipping resistance. Specimen steels, O, P, Q, R, S, U, and V, have poor low temperature chipping resistance due to low Si content of the respective steels. Specimen steels, S, T, and U, each having a content of Ti and Nb combined in excess of a range specified by the present invention, have little bake hardenability although an amount of solute carbon is within the specified range.

Example 2

Slabs of chemical compositions denoted by symbols A, B, and C, respectively, in the Table 1, were hot rolled, descaled in the acid bath, and cold rolled into cold rolled steel sheets, each 0.70 mm in thickness, under the conditions similar to that described in Embodiment 1. A specimen 200 mm long and 80 mm wide was cut out from each of the cold rolled steel sheets.

The hot-dip galvanizing and Fe—Zn alloying processes were applied to the specimens by use of the simulator. The hot-dip galvanizing was performed by preheating the specimens, followed by annealing at 800° C. for a retention time of 60 min reducing atmosphere, and immersing in the galvanizing bath at 460° C. under the conditions similar to that in the case of Example 1. An amount of the galvanized coating was adjusted to be 35 g/m$^2$ on one side of the respective specimens by varying amounts of high pressure air blasted.

Galvanized specimens were cooled to room temperature, and heated up to 530° C.±10° C. using the induction heating apparatus. The Fe—Zn alloying process was applied by varying a retention time at the Fe—Zn alloying temperature within 20 sec such that a Fe content of the galvannealed coating falls within a predetermined range. Thereafter, the specimens were cooled down to room temperature at varying cooling velocity by blowing nitrogen gas or spraying water to the surface of the specimens.

Mechanical properties, powdering resistance, and low temperature chipping resistance of the galvannealed steel sheet specimens were evaluated in the same manner as described in the case of Experiment 1. The results of such evaluation are shown in Table 3.

TABLE 3

| | | Fe—Zn alloying condition | | | Mechanical Properties | | | |
|---|---|---|---|---|---|---|---|---|
| Test Piece | Specimen Steel | Heating Velocity (° C./s) | Cooling Velocity (° C./s) | Fe Content of Coating (wt %) | Tensile Strength (MPa) | Bake Hardenability (MPa) | Powdering Resistance *1 | Low Temperature Chipping Resistance *2 |
| 31 | A | 25 | 15 | 11 | 360 | 18 | ⊛ | ⊛ |
| 32 | A | 25 | 7 | 12 | 356 | 13 | ○ | ⊛ |
| 33 | A | 15 | 15 | 12 | 360 | 18 | ⊛ | ○ |
| 34 | A | 15 | 7 | 15 | 356 | 12 | ○ | ○ |
| 35 | B | 25 | 15 | 8 | 357 | 41 | ⊛ | ⊛ |
| 36 | B | 25 | 7 | 11 | 353 | 35 | ○ | ⊛ |
| 37 | B | 15 | 15 | 10 | 357 | 40 | ⊛ | ○ |
| 38 | B | 15 | 7 | 12 | 353 | 34 | ○ | ○ |
| 39 | C | 25 | 15 | 12 | 362 | 40 | ⊛ | ⊛ |
| 40 | C | 25 | 7 | 10 | 358 | 35 | ○ | ⊛ |
| 41 | C | 15 | 15 | 12 | 362 | 40 | ⊛ | ○ |
| 42 | C | 15 | 7 | 10 | 358 | 35 | ○ | ○ |

note)
*1 Powdering Resistance
⊛ : less than 15 mg,
○: 15 mg or above but less than 25 mg,
Δ: 25 mg or above but less than 35 mg,
x: 35 mg or above.
*2 Low Temperature Chipping Resistance
⊛ : less than 2.5 mm,
○: 2.5 mm or above but less than 3.5 mm,
Δ: 3.5 mm or above but less than 4.5 mm,
x: 4.5 mm or above.

Specimen steels A, B, and C are all of chemical composition specified by the present invention. As shown in Table 3, all the specimens in this embodiment have tensile strength of 340 MPa and higher, adequate bake hardenability, and excellent powdering resistance as well as low temperature chipping resistance.

In particular, the galvannealed steel sheet, manufactured by either increasing the velocity of heating up to the Fe—Zn alloying temperature, or increasing the velocity of cooling down to room temperature after the alloying process, demonstrated superior low temperature chipping resistance and bake hardenability.

As described in the foregoing, the galvannealed steel sheet according to the present invention, and the galvannealed steel sheet manufactured by the method according to the present invention have high strength, and sufficient paint bake hardenability, and excel in powdering resistance and low temperature chipping resistance. Said steel sheets having all the properties required of steel sheets that can be put to use in the bodies of new model automobiles are capable of bringing about beneficial effects to the industry such as better performance of automobiles, rationalization of production, and the like.

We claim:

1. A galvannealed steel sheet comprising a base metal and a galvannealed coating formed on the surface of the base metal, said base metal having the following chemical composition on the basis of percent by weight, said steel sheet having tensile strength of 340 MPa or higher, paint bake hardenability of 10 MPa or higher, and excellent properties in respect to powdering resistance and low temperature chipping resistance:

C: 0.004 to 0.008%; Si: 2.5×P(%) to 0.20%;

Mn: 0.10 to 0.40%; P: 0.017–0.045%;

sol. Al: 0.003 to 0.08%; S: 0.015% or less;

Ti: 0.002 to 0.015%; Nb: 0.010 to 0.030%;

Ti(%)+Nb(%): 0.012 to 0.035%; N: 0.004% or less;

balance: Fe and inevitable impurities.

2. A galvannealed steel sheet according to claim 1, wherein the C, P, and sol. Al content in the base metal are as follows:

C: 0.005 to 0.007%; P: 0.017 to 0.035%;

sol. Al: 0.003 to 0.04%.

3. A galvannealed steel sheet according to claim 1, wherein the Si content in the base metal satisfies the following formula:

$$2.5\times P(\%)\leqq Si\leqq(-6/7)\times P(\%)+0.16.$$

4. A galvannealed steel sheet according to claim 1, wherein amounts of C, P, sol. Al and Si in the base metal are as follows:

C: 0.005–0.007%, P: 0.017–0.035%, sol. Al: 0.003–0.04%, $2.5\times P(\%)\leqq Si\leqq(-6/7)\times P(\%)+0.16$.

5. A method of manufacturing a galvannealed steel sheet having tensile strength of 340 MPa or higher, paint bake hardenability of 10 MPa or higher, and excellent properties in respect of powdering resistance and low temperature chipping resistance, which comprises the steps of hot-dip galvanizing a base metal having the following chemical composition, on the basis of percent by weight, heating the same up to a Fe—Zn alloying temperature at a heating velocity of 20° C./second or higher for application of a Fe—Zn alloying process, and cooling the same at a cooling velocity of 10° C./second or higher:

C: 0.004 to 0.008%; Si: 2.5×P(%) to 0.20%;

Mn: 0.10 to 40%; P: 0.017 to 0.045%;

sol. Al: 0.003 to 0.08%; S: 0.015% or less;

Ti: 0.002 to 0.015%; Nb: 0.010 to 0.030%;

Ti(%)+Nb(%): 0.012 to 0.035%; N: 0.004% or less;

balance: Fe and inevitable impurities.

6. A method of manufacturing a galvannealed steel sheet according to claim 5, wherein the C, P, and sol. Al content in the base metal are as follows:

C: 0.005–0.007%; P: 0.017–0.035%;

sol. Al: 0.003–0.04%.

7. A method of manufacturing a galvannealed steel sheet according to claim 5, wherein the Si content in the base metal satisfies the following formula:

$$2.5\times P(\%)\leqq Si\leqq(-6/7)\times P(\%)+0.16.$$

8. A method of manufacturing a galvannealed steel sheet according to claim 5, herein the C, P, sol. Al and Si content in the base metal are as follows:

C: 0.005–0.007%; P: 0.017–0.035%;

sol. Al: 0.003–0.04%;

$2.5\times P(\%)\leqq Si\leqq(-6/7)\times P(\%)+0.16$.

* * * * *